US011007386B2

(12) United States Patent
Cowhig et al.

(10) Patent No.: US 11,007,386 B2
(45) Date of Patent: May 18, 2021

(54) ASPIRATOR FOR AIR FLOW AMPLIFICATION

(71) Applicants: Aidan J. Cowhig, Arlington, VA (US); Alexander M. Dixon, Fairfield Township, OH (US); Brian K. Johnson, Virginia Beach, VA (US); James M. Lambeth, Washington, DC (US); Richard A. Graves, Virginia Beach, VA (US); Andrew L. Levy, Chesapeake, VA (US)

(72) Inventors: Aidan J. Cowhig, Arlington, VA (US); Alexander M. Dixon, Fairfield Township, OH (US); Brian K. Johnson, Virginia Beach, VA (US); James M. Lambeth, Washington, DC (US); Richard A. Graves, Virginia Beach, VA (US); Andrew L. Levy, Chesapeake, VA (US)

( * ) Notice: Subject to any disclaimer, the term of this patent is extended or adjusted under 35 U.S.C. 154(b) by 0 days.

(21) Appl. No.: 16/195,911

(22) Filed: Nov. 20, 2018

(65) Prior Publication Data

US 2019/0192884 A1 Jun. 27, 2019

Related U.S. Application Data

(60) Provisional application No. 62/588,945, filed on Nov. 21, 2017.

(51) Int. Cl.

| | |
|---|---|
| ***A62B 7/02*** | (2006.01) |
| ***B63B 7/00*** | (2020.01) |
| ***A62B 9/02*** | (2006.01) |
| ***F04F 5/20*** | (2006.01) |
| ***F04F 5/16*** | (2006.01) |
| ***F15D 1/02*** | (2006.01) |

(Continued)

(52) U.S. Cl.

CPC ..... *A62B 7/02* (2013.01); *A62B 9/02* (2013.01); *B63B 7/00* (2013.01); *F04F 5/16* (2013.01); *F04F 5/20* (2013.01); *F15D 1/025* (2013.01); *A62B 99/00* (2013.01); *B63C 11/18* (2013.01)

(58) Field of Classification Search

CPC ..... A62B 7/02; A62B 7/00; A62B 9/02; F04F 5/16; F04F 5/20; A63B 7/02; B63B 7/00

See application file for complete search history.

(56) References Cited

U.S. PATENT DOCUMENTS 3,451,409 A * 6/1969 Roche ..... F15C 1/008 137/807

3,636,964 A * 1/1972 Colamussi ..... F04F 5/465 137/13

(Continued)

*Primary Examiner* — Stephen P Avila

(57) ABSTRACT

An augmentation amplifier is provided for aspirating gas flow from a surrounding medium. The amplifier connects at an inlet to a pressurized gas source and at an outlet to a gas receiver. Ambient gas from the medium supplements source provided compressed gas. The amplifier includes a Venturi conduit including a throat, an external cavity and a diffusion chamber. The conduit receives and flows pressurized gas from the inlet to the throat. The cavity receives ambient gas from the medium. The chamber expands and accelerates the pressurized gas from the throat to entrain the ambient gas via aspiration. The accelerated and ambient gases combine into an exhaust gas to the outlet.

9 Claims, 6 Drawing Sheets

(51) Int. Cl.
*A62B 99/00* (2009.01)
*B63C 11/18* (2006.01)

(56) References Cited

U.S. PATENT DOCUMENTS 4,566,862 A * 1/1986 Halavais ..... F04F 5/48
417/174
2016/0102682 A1* 4/2016 Gass ..... F04F 5/20
417/179

* cited by examiner

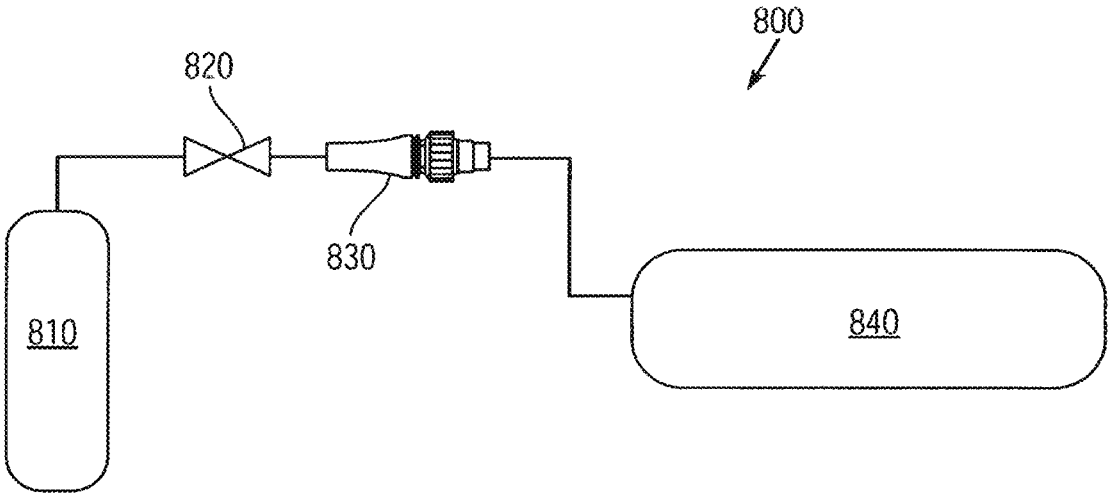

Fig. 8

900

Table 1: Initial Field Test Results

| Test 910 | Inline Amplifier | Radial Amplifier |
|---|---|---|
| Bottle Initial Pressure (psig) | 2800 | 2050 |
| Bottle Final Pressure (psig) | 2010 | 900 |
| Boat Final Pressure (psig) | 0.21 | 0.21 |
| Time to inflate to 15 psig (min:sec) | 9:15 | 2:00 |
| Calculated Amplification Factor | 3.27 | 2.25 |

Table 2: Compression Test Results

| Test 920 | Time to Inflate (minutes) |
|---|---|
| Control (No Amplifier) | 3:10 |
| Inline Amplifier | 2:35 |

Table 3: Full Inflation Field Test Results

| Test (Inline Amplifier) 930 | Time to Inflate (minutes) | Amplification Factor |
|---|---|---|
| Full Volume/No Pressurization | 0:56:38 | 3 |
| Pressurization to 3.5 psi | 1:55:65 | 1.71 |

Fig. 9

ASPIRATOR FOR AIR FLOW AMPLIFICATION

CROSS REFERENCE TO RELATED APPLICATION

Pursuant to 35 U.S.C. § 119, the benefit of priority from provisional application 62/588,945, with a filing date of Nov. 21, 2017, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to air amplification aspirators. In particular, the invention relates to devices to augment compressed air from high pressure containers to include ambient air from the atmosphere for inflation.

Inflatable boats, such as the Zodiac FC470™ are used by military personnel for various littoral missions. As stowed, the FC-470 has folded dimensions (in feet/inches) of 2' 6"×4' 11" with an empty weight of 322 $lb_m$ (10.0 slugs). Fully inflated, the FC-470 has deployed length and width of 15' 5" and 10' 10", respectively. Compressed air from a pressurized tank is used to inflate such a boat. For example, self-contained underwater breathing apparatus (SCUBA) tanks can be employed for this purpose.

SUMMARY

Conventional aspirators yield disadvantages addressed by various exemplary embodiments of the present invention. In particular, various exemplary embodiments provide an augmentation amplifier for aspirating gas flow from a surrounding medium for supplementing compressed gas sources. The amplifier connects at an inlet to a pressurized gas source and at an outlet to a gas receiver. Ambient gas from the medium supplements source provided compressed gas.

The exemplary amplifier includes a Venturi conduit including a throat, an external cavity and a diffusion chamber. The conduit receives and flows pressurized gas from the inlet to the throat. The cavity receives ambient gas from the medium. The chamber expands and accelerates the pressurized gas from the throat to entrain the ambient gas via aspiration. The accelerated and ambient gases combine into an exhaust gas to the outlet.

BRIEF DESCRIPTION OF THE DRAWINGS

These and various other features and aspects of various exemplary embodiments will be readily understood with reference to the following detailed description taken in conjunction with the accompanying drawings, in which like or, similar numbers are used throughout, and in which:

FIG. 8 is a diagram view of an operational installation; and

FIG. 9 is a tabular view of empirical test data of the amplifiers.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in feet (ft) or inches (in), volume in cubic feet ($ft^3$), mass in slugs, grams (g) or kilograms (kg), time in seconds (s), force in pounds-force ($lb_f$) or newtons (N), energy in British thermal units (Btu) or joules (J), temperature in kelvins (K) or degrees Rankine (° R), and material quantity in moles (mol). Supplemental measures can be derived from these, such as density in slugs-per-cubic-foot (slug/$ft^3$) or grams-per-cubic-centimeters (g/$cm^3$), pressure in pounds-per-square-inch (psi) either gage (psig) or absolute (psis), gas constant in cubic-feet-pounds-per-square-inch-per-slug-degree-Rankine ($ft^3$-psi/slug-° R) or joules-per-kelvin-kilogram (J/K-kg) and the like.

Personnel in explosive ordinance disposal (EOM need to reduce the amount of compressed air stored within their boats. The exemplary air amplifier is a small device that reduces the amount of tanked compressed air required for inflating collapsible boats, such as the Zodiac FC-470. The exemplary embodiments exploit the advantage of the Venturi effect and the conservation of mechanical energy. The principles described herein reference air as the flow medium. However, artisans of ordinary skill will recognize that the exemplary embodiments remain applicable any medium in gaseous state, e.g., compressible Newtonian fluid such as a gas or vapor.

Without any air amplification, inflation of an FC-470 boat requires multiple standard-size SCUBA tanks, which are costly in terms of both weight and physical volume. Standard practice constitutes carrying a minimum of two SCUBA tanks onboard to ensure a single complete inflation. Utilizing exemplary air amplification reduces the amount of carried air needed and, consequently, reduces weight and saves space on the boat while accelerating its inflation.

Figure 1A:
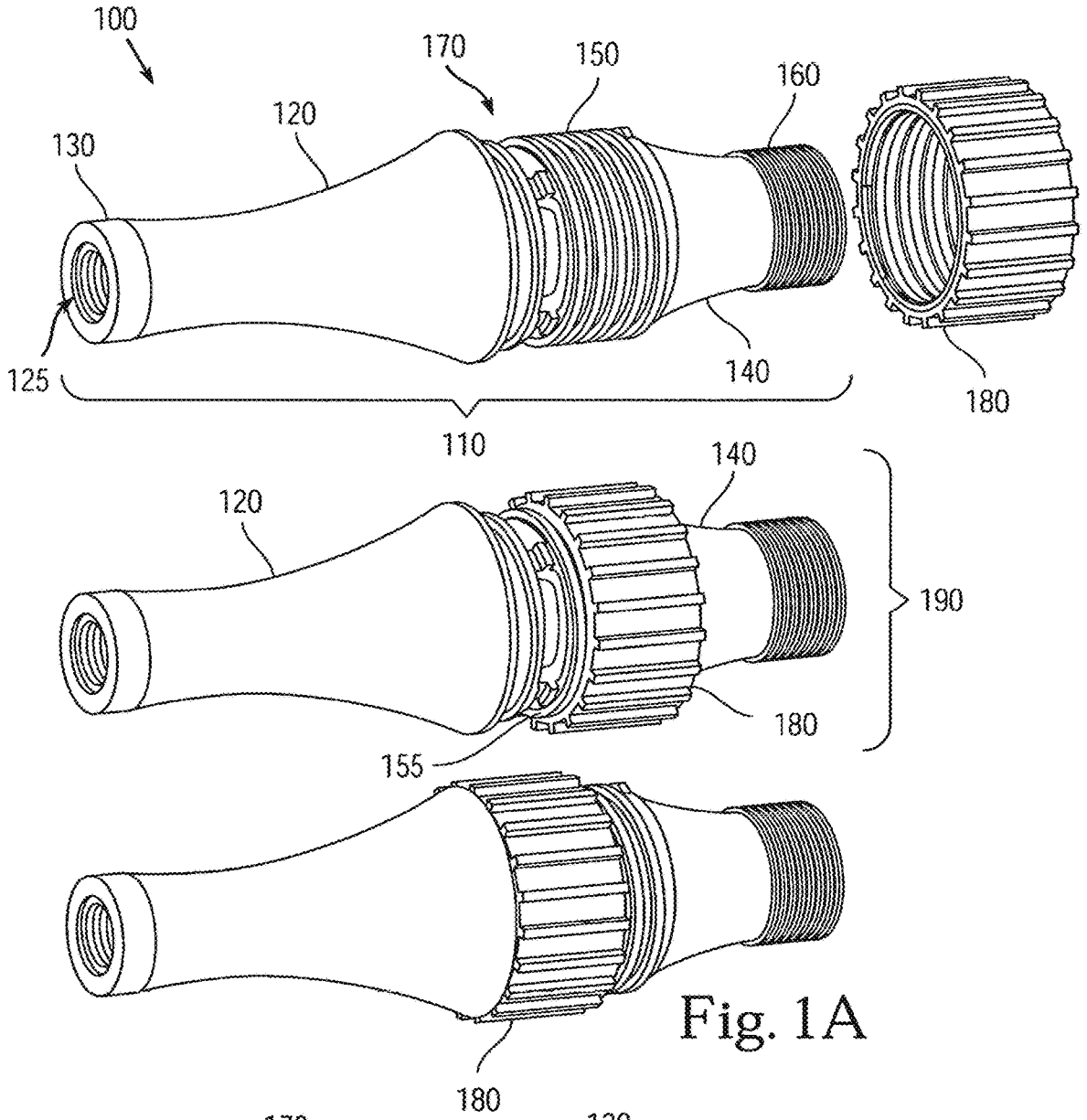
FIG. 1A is a set of perspective views of an inline amplifier.
Figure 1B:
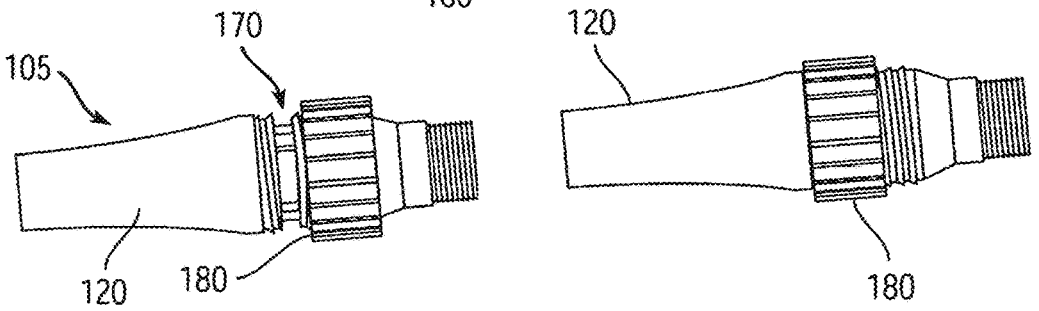
FIG. 1B is a set of elevation views of the inline amplifier.

FIG. 1A shows a set of isometric views 100 of an inline airflow amplifier. Similarly, FIG. 1B shows a set of elevation views 105 of the exemplary amplifier. An integrated housing 110 includes an integral forebody 120 with a female threaded orifice 125 that opens in an inlet 130, aftbody 140 with male threaded midbody 150 connected to the forebody by four angularly interspaced bridges 155, and aft male threaded external thread 160. An annular aspiration cavity 170 is disposed between the forebody 120 and the midbody 150. A knurled detachable cinch ring 180 screws to the midbody 150 via female threads. The aspiration assembly 190 includes the housing 110 and ring 180. The housing 110 is substantially axi-symmetric.

Air can flow into or out of the annular cavity 170 with the cinch ring 180 positioned along the distal portion of the midbody 150 (in relation to the inlet 130). This constitutes an open ring position on the left in view 105. Turning the cinch ring 180 forward along the midbody 150 towards the inlet 130 to obstruct the cavity 170, blocks the cavity 170 from ambient. This constitutes a closed ring position on the right in view 105.

Figure 2:
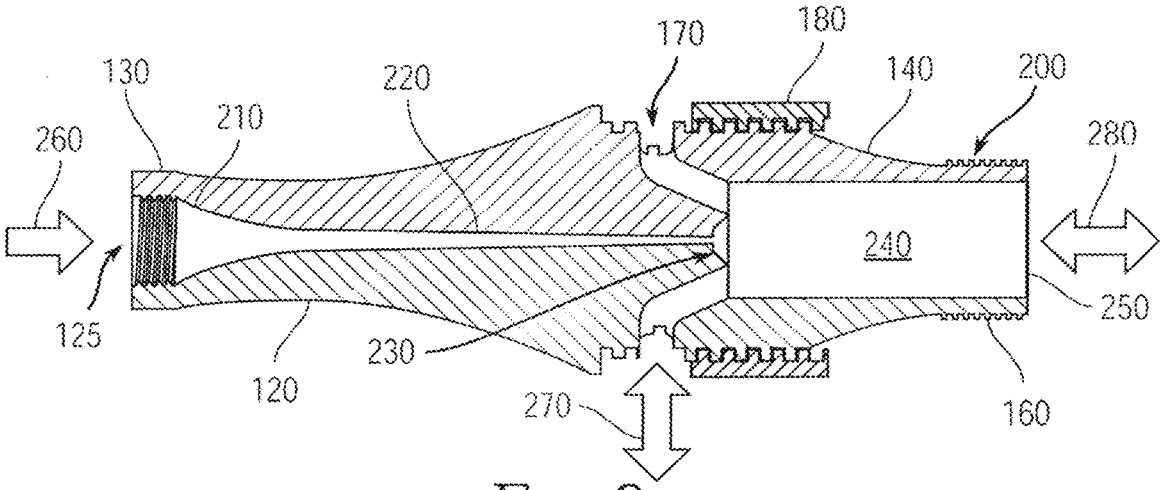
FIG. 2 is a cross-section elevation view of the inline amplifier.

FIG. 2 shows a cross-section elevation view 200 of the inline airflow amplifier. The forebody 120 includes a compressor orifice 210 into a tapering conduit 220 that leads through an expansion cone 230 into a cylindrical chamber 240 in the aftbody 140. Supply air from a high-pressure source, such as compressed gas bottle (e.g., SCUBA tank) or a pump, is pressure-fed as inlet air flow 260 into the orifices 125 and 210. Air passes from the compressor orifice 210 to an outlet 250 that connects to a receiver, such as the boat to be inflated.

The air compresses through the conduit 220, and then expands in the cone 230, thereby accelerating and increasing dynamic pressure. The resulting static pressure reduction entrains ambient air through the cavity 170 as supplemental air flow 270. For this context, ambient refers to atmospheric air beyond the amplifier assembly 190. Artisans of ordinary skill will recognize that this effect applies to any compressible medium within which the aspirating amplifier operates. Both inlet air streams expand through the chamber 240 and exit through the outlet 250 as exhaust air flow 280. Air passage through the conduit 220 as a Venturi chokes, transitioning the flow from subsonic in the conduit 220 to supersonic in the chamber 240.

In view 200, the flow arrow directions for supplemental air flow 270 and exhaust air flow 280 point both inward and outward to illustrate their conditional operational nature. For amplification to aspirate ambient air into the receiver, the supplemental air flow 270 flows into the annular cavity 170 for aspiration into the chamber 240, and the combined exhaust air flow 280 flows out from the outlet 250. To obviate installation of a check valve in the inlet 130, air backflows as reverse exhaust air flow 280 into the outlet 250 can be vented as excess air flow 270 through the annular cavity 170 into ambient, thereby avoiding overpressure from the supply air flow 260. This option to eschew check valve incorporation eliminates an obstacle that would have excessive flow resistance.

The exemplary housing 110 has an overall length 5", diameter of the orifice 125 of ½", diameter of the chamber 240 of 11/16", and a gap length of the cavity 170 of 1/16". The ring 180 has an outer diameter of ~1¾". The conduit 220 has a choke diameter of ~⅛". The housing 110 can be fabricated by a three-dimensional (3D) printer from Onyx® from Markforged, Inc. (Cambridge, Mass.). Onyx® represents a nylon composite fused filament with micro-carbon reinforcement through additive manufacture by the 3D printer. Other materials were investigated, including thermoplastic (e.g., ABS-ESDI), polycarbonate, photopolymer, and Digital ABS® from Stratasys (Eden Prarie, Minn.). Despite ease of manufacture, polycarbonate and ABS-ESD7 were deemed too porous and Digital ABS was deemed too brittle for this intended usage.

The inline housing 110 employs the Venturi effect to entrain supplemental ambient air flow 270 to augment the supply air flow 260 for exiting into the receiver as exhaust air flow 280. The Venturi effect reduces pressure in a high-speed jet of fluid, being a byproduct of the conservation of mechanical energy, which can be described by Bernoulli's equation:

$$P_i + \frac{\rho v_i^2}{2} + \rho g h_i = P_o + \frac{\rho v_o^2}{2} + \rho g h_o, \tag{1}$$

where P refers to fluid pressure, p is density of the fluid, which for air at sea level is 1.225 kg/m$^3$ or 0.002377 slug/ft$^3$, v is the velocity of the fluid, g is gravitational acceleration of 9.8 m/s$^2$ or 32.1 ft/s$^2$, h is the vertical position of the fluid, and subscripts i and o respectively denote inlet and outlet. Each side of eqn. (1) refers to separate states of the same fluid in an isolated system. The Venturi effect, being related to pressure and velocity, does not involve changes in potential energy and so the ρ g h terms can be cancelled.

From eqn. (1), a direct relationship between pressure and velocity can be arranged to further clarify this as:

$$P_i - P_o = \frac{\rho(v_o^2 - v_i^2)}{2}, \tag{2}$$

exhibiting the Venturi effect, with pressure difference proportionally responding to the negative square of velocity changes. The peak velocity through the throat in the channel 220 having a cross-section area of 0.0123 in$^2$ is 343 m/s or 1125 ft/s. For an ideal gas, the pressure ratio can be expressed as:

$$\frac{P^*}{P_i} = \left(\frac{2}{\gamma + 1}\right)^{\frac{\gamma}{\gamma - 1}}, \tag{3}$$

where P* is critical downstream pressure, and γ is the ratio of specific heats, which corresponds to a value of 1.4 for diatomic nitrogen and oxygen, yielding a pressure ratio of 0.528 for choked flow. Pressure at the SCUBA tank is 2800 psig, but regulated down to 60 psig, which serves as inlet pressure. This yields a maximum downstream pressure well above that needed for choked flow and thus air flows along the chamber 240 at supersonic speed.

Ideal gas law is expressed as a relation of pressure times volume being proportional to mass and temperature:

$$PV = mRT, \tag{4}$$

where V is volume in cubic feet, m is mass in slugs and T is temperature in degrees Rankine. The gas constant R for a particular medium is based on:

$$R = \frac{\mathfrak{R}}{M}, \tag{5}$$

where $\mathfrak{R}$ is Boltzmann constant and M denotes molecular weight. The Boltzmann constant is 8.314 J/K-mol, which equals 1.986 Btu/° R-lb-mole or 10.731 ft$^3$-psi/° R-lb-mole.

For air, molecular weight is 28.97 g/mol, so that the gas constant is 287.058 J/kg-K or 1.716 ft-lbf/slug-° R. The mass in a container (for a source or a receiver) can thus be rewritten as:

$$m = \frac{PV}{RT}. \tag{6}$$

The locations of interest are supply source and end receiver, denoted by respective subscripts s and r. For purposes of the quantitative examples provided, these involve a pressurized SCUBA tank for the source, and an inflatable boat as the receiver. Thus, source volume is V, of 0.39 $ft^3$ and receiver volume is $V_v$ of 65.7 $ft^3$. The states of interest are beginning and final, denoted by respective subscripts b and f. Hence, beginning mass of the source is $m_{sb}$, final mass of the source is $m_{xf}$, and final mass of the receiver is $m_{rf}$. Empirical values were established by the fleet integration and readiness engineering (FIRE) laboratory.

The exemplary amplifier exhibits an amplification factor $F_{amp}$ as an advantageous measure of improvement by the relation:

$$F_{omp} = \frac{m_r}{\Delta m_s}, \tag{7}$$

where the source tank's mass depletes while the receiver is filled as:

$$\Delta m_s = m_{sb} - m_{sf}, \tag{8}$$

depending on the air amplifier configuration. The final receiver pressure $P_{rf}$ in the inflatable boat is 0.21 psig.

For the inline configuration using the inline aspiration assembly 190, beginning supply pressure $P_{sb}$ is 2800 psig and final supply pressure $P_{sf}$ is 2010 psig (both converted to pounds-per-square-foot-absolute). At room temperature T of 529° R, eqn. (6) yields initial and ending masses in the SCUBA tank at 0.1742 slug and 0.1252 slug. The corresponding final mass in the boat after completing inflation is 0.1555 slug. From eqn. (7), this yields an amplification factor by 0.1555/(0.1742−0.1252) that equals 3.18, meaning the boat is inflated with more than twice as much air from the atmosphere as from the supply bottle. Inflation time for the inline configuration was 9:15 minutes.

Figure 3:
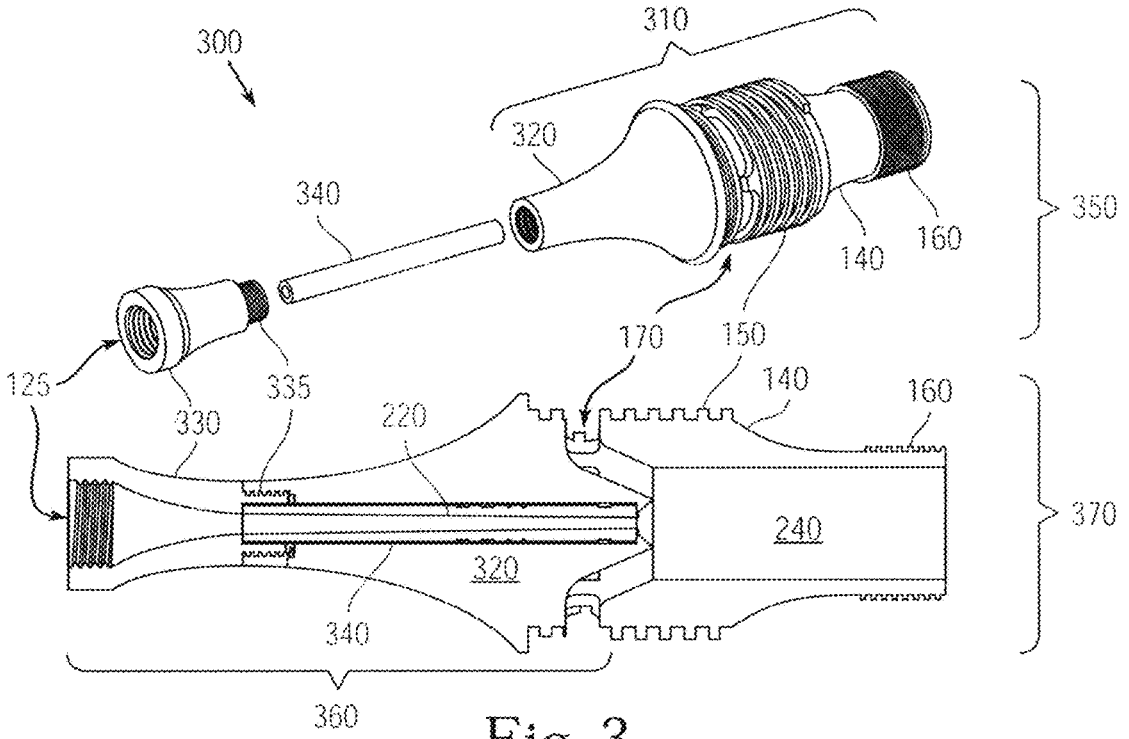
FIG. 3 is a set of perspective and cross-section elevation views of a modular inline amplifier.

FIG. 3 shows a set of isometric and cross-section elevation views 300 of an inline airflow amplifier with modular forebody. A Venturi housing 310 includes a forebody 320 that attaches to the midbody 150. An inlet 330 includes an inner male thread extension 335 that screws into the forebody 320 via female threads together with an inner tube 340 inserted into the forebody 320. The concatenated aspirator 350 includes this subassembly together with the aftbody 140 and male thread 160. The separable forebody 320, inlet 330 and tube 340 form an assembly forebody 360, serving the same function as the integral forebody 120. The inner tube 340 includes tapering conduit 220 that forms a throat at its interface to the cone 230.

Figure 4:
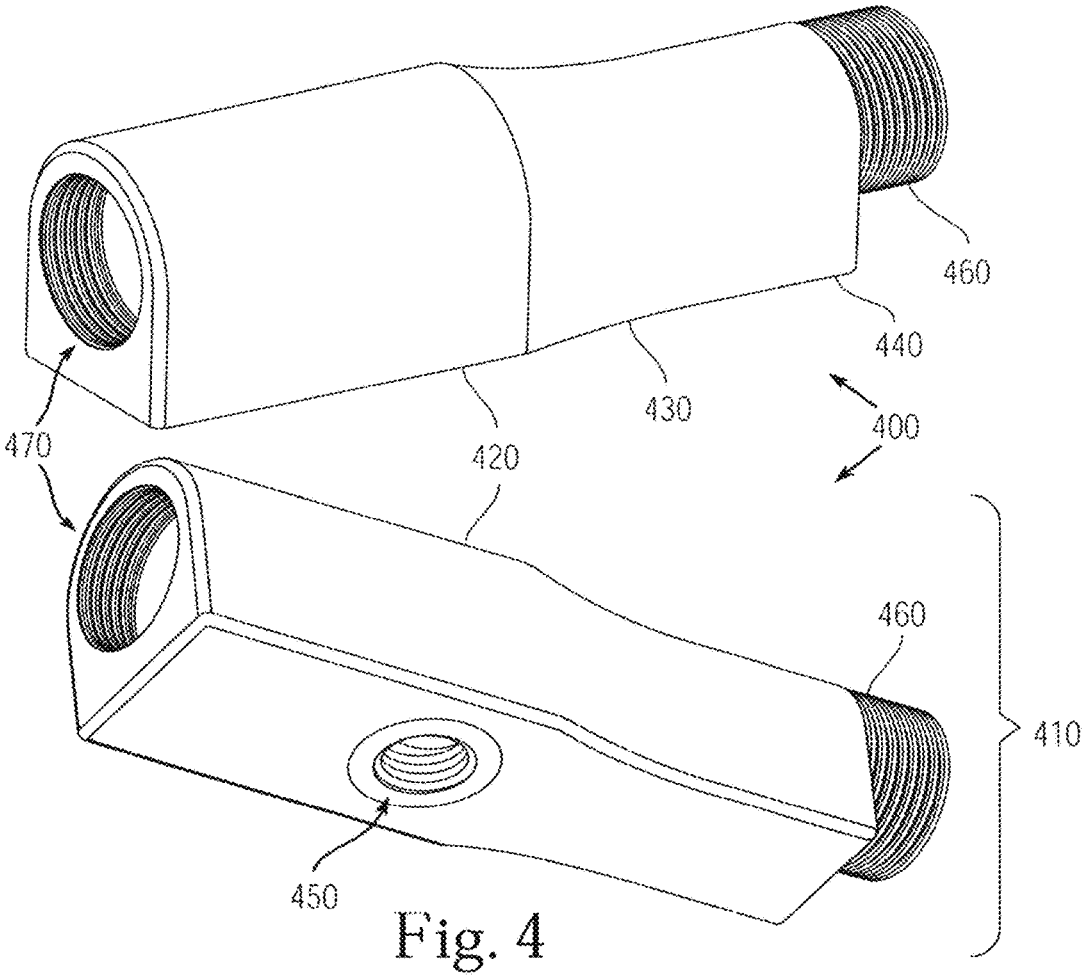
FIG. 4 is a set of perspective views of a radial amplifier.

FIG. 4 shows a set of isometric views 400 of a radial airflow amplifier with a non-axisymmetric housing 410. This housing 410 includes a forebody 420, a tapering midbody 430 and an aftbody 440. A lateral inlet 450 with female threads enters the forebody 420 to receive pressurized air. The aftbody terminates with an exit extension 460 with male threads. An axial proximal inlet 470 with female threads enters the forebody 420 to receive ambient air. The combined supplies of air exit from an axial outlet within the extension 450.

Figure 5:
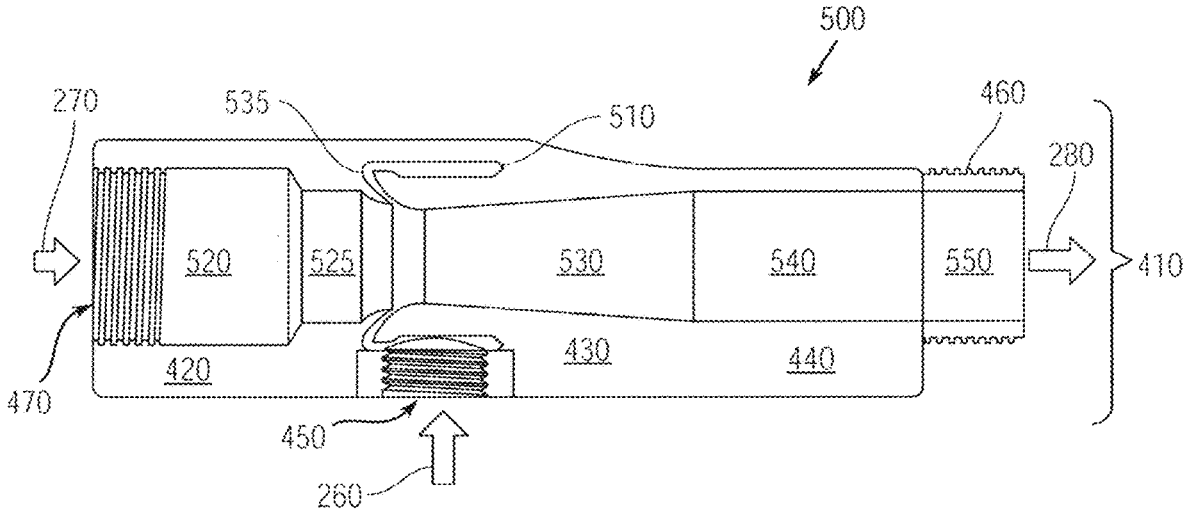
FIG. 5 is a cross-section elevation view of the radial amplifier.

FIG. 5 shows a cross-section elevation view 500 of the non-axisymmetric housing 410 for the radial amplifier. An annular manifold 510 receives air from the lateral inlet 450. An axial channel 520 in forebody 420 aligns with the ambient inlet 470, directing air flow through a compressor 525 to enter a frustum diffuser 530. A ring nozzle 535 connects the manifold 510 with the diffuser 530. Air entering the diffuser 530 from the compressor 525 and the nozzle 535 feeds into axial channels 540 and 550 together with the axial channel 510. The channel 530 straddles between the forebody 420 and the midbody 430. The channels 540 and 550 are disposed in the aftbody 440, with the channel 550 corresponding to the threaded extension 460.

The Coanda effect describes the tendency of a fast-moving stream of air to "hug" a curved surface. In contrast to the inline version, the radial configuration with the non-axisymmetric housing 410 employs both the Venturi effect and the Coanda effect. As shown in view 500, high pressure air flow 260 enters the supply inlet 450 and into the manifold 510, and travels perpendicular to the direction of airflow into the receiver through the channel 550.

By Bernoulli's principle, a high-speed jet of air (with higher dynamic pressure) has a lower static pressure than the surrounding (low-speed) air. In an unrestricted path, low pressure attracts ambient air from all sides into the jet of air. The jet can be applied to a curved surface, such as the ring nozzle 635. These conditions isolate the jet, precluding adjacent air to join the stream from the direction of the surface. Therefore, the area of low pressure remains at the curved surface, and the force of the ambient air (at standard atmospheric pressure) forces the stream against the low pressure surface.

The air routes from the manifold 510 through the narrow curved ring nozzle 635 (combining with the ambient air flow 270) to the diffuser 530 by utilizing the Coanda effect with a curved surface. The combined air flows exit through the passage 550 as the exhaust air flow 280. At the outlet of the ring nozzle 535, a low pressure region arises through the Venturi effect. This draws the ambient atmosphere in through the axial inlet 470 to supplement the compressed air for boat inflation. Unlike the inline configuration for assembly 190, the radial configuration incorporates a check valve at the lateral inlet 450 to prevent backpressure from expelling air upon initiation of boat pressurization.

For the radial configuration using the non-symmetric aspiration housing 410, beginning supply pressure $P_{sb}$ is 2050 psig and final supply pressure $P_{sf}$ is 900 psig. At room temperature T of 529° R, eqn. (6) yields initial and ending masses in the SCUBA tank at 0.1277 slug and 0.0565 slug. The corresponding final mass m in the boat after completing inflation is 0.1555 slug. From eqn. (7), this yields an amplification factor $F_{amp}$ of 0.1555/(0.1277−0.0565) that equals 2.18, meaning the boat inflates with more air from the atmosphere as from the supply bottle. Inflation time for the radial configuration was 2:00 minutes. Thus, the radial configuration can fill the boat in about one-fifth the time of the inline configuration, albeit with lesser amplification.

Both inline and radial designs include threads printed directly onto the device to interface with the inflatable boat and compressed air tank without requiring any additional hardware via additive manufacturing by a 3D printer. An adapter kit that provides compatibility with all inflatables across all branches of the military is in preparation. Exemplary embodiments have utility for commercial ships with small inflatable rafts that inflate from finite quantities of stored compressed air. There may be potential support capabilities for inflatable items unrelated to ships, such as camping air mattresses or emergency inflatable watercraft, such as those found on airplanes, or life jackets.

Figure 6:
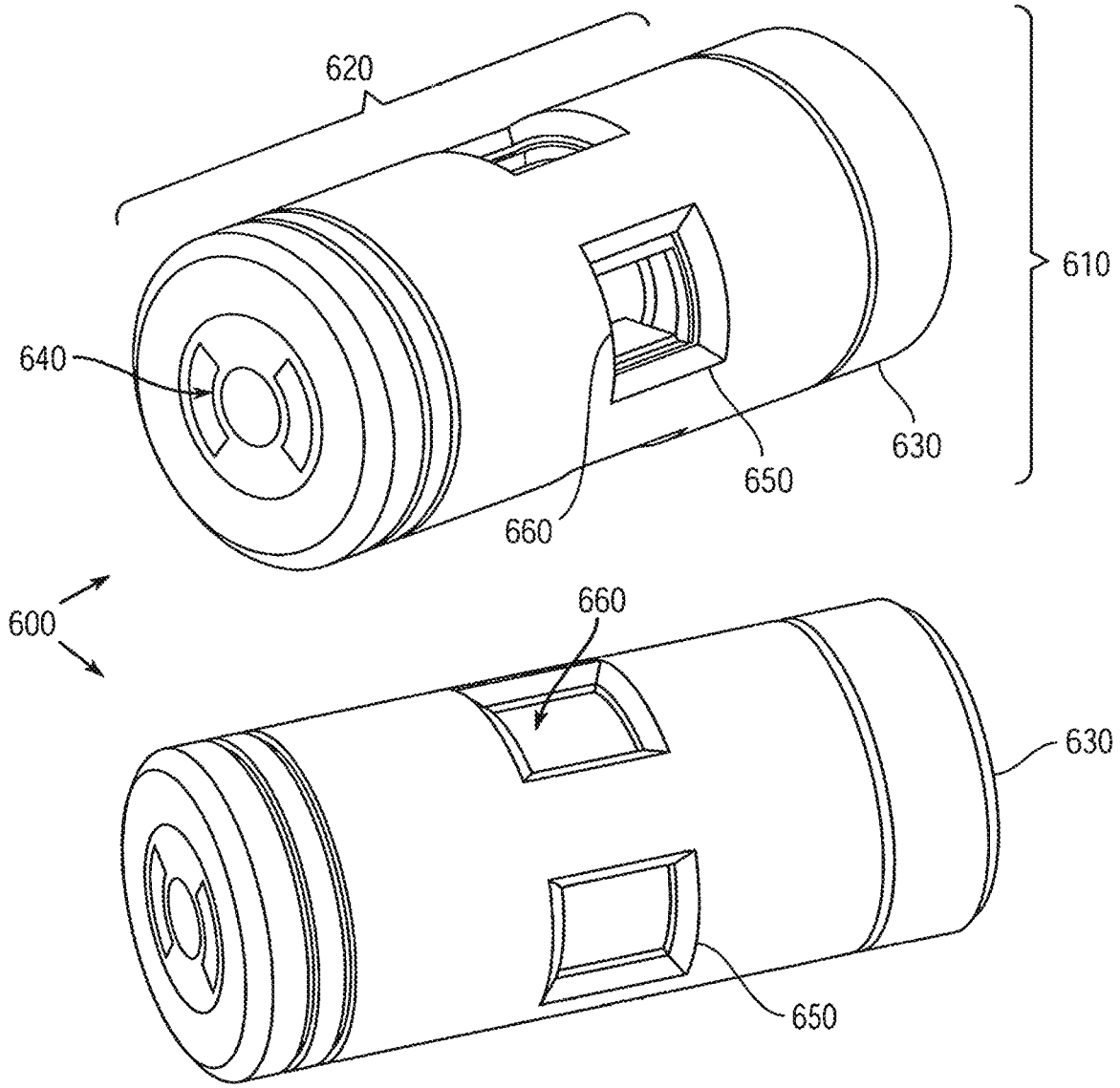
FIG. 6 is a set of perspective views of a shell amplifier.

FIG. 6 shows a set of isometric views 600 of an annular shell assembly 610 for an alternate inline configuration. An annular forebody 620 receives a modular aftbody 630. An annular inlet 640 includes female threads to receive a high pressure air supply. The forebody 620 includes angularly distributed radially extending square-shape windows 650 for selective exposure to ambient. The aftbody 630 includes angular shutters 660 that rotate to controllably open and close the windows 650.

Figure 7:
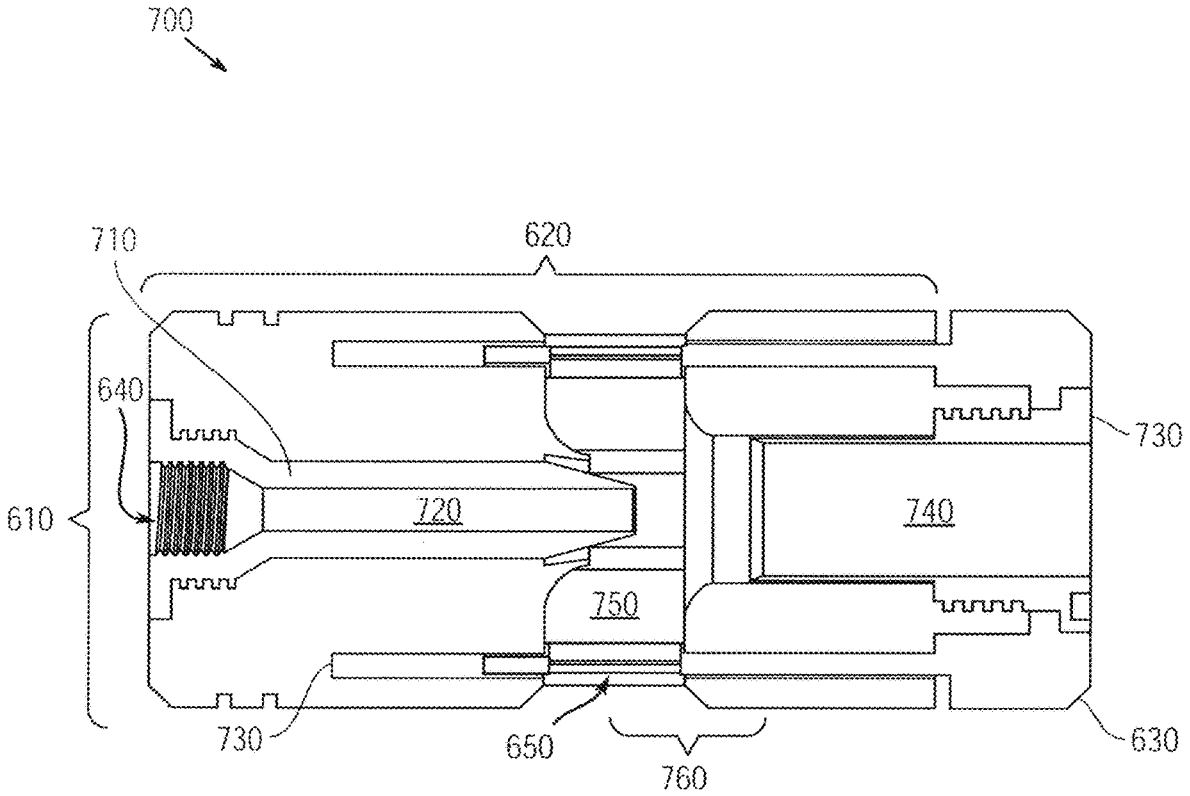
FIG. 7 is a cross-section elevation view of a shell amplifier.

FIG. 7 shows a cross-section elevation view 700 of the shell assembly 610. An annular insert tube 710 within the forebody 620 includes a cylindrical channel 720 downstream of the inlet 640. An aft insert plug 730 is disposed within the aftbody 630 and includes an annular passage 740. An internal manifold 750 connects the channel 720, passage 740 and windows 650 to enable rotation of the aftbody 630 for opening and closing the shutters 660, which operate in a similar manner to the cinch ring 180.

The aft body 630 that includes an adapter ring with shutters 660 can be used to seal ambient inlet windows 650. For versatility, the aft body 630 can be replaced with an alternate with distinct internal geometry, such as by different sized hole openings. This enables optimization customization of the inflation speed versus amplification factor. Further embodiments provide a protective shell of the housing 620 out of a resilient material. This assembly 610 features a revolving door assembly to open and close the air inlet windows 650. The assembly 610 should preferably be composed from air permeable for the forebody 620 and aftbody 630, and the remainder from non-air permeable material that can be sensitive to ultraviolet (UV) light. Ultimately, the shell configuration for assembly 610 was deemed less effective than the inline or radial versions.

For traditional manufacturing, the assembly should preferably be subdivided into multiple components for assembly to accommodate the intricate manifold geometry. There are also other design considerations not explored currently, such as implementing a check valve onto the inline assembly 190.

FIG. 8 shows an operational diagram view 800 of the amplifier 190 as configured for inflation usage. A high-pressure storage tank 810 connects to a pressure regulator 820. A generic amplifier 830 (with the inline illustrated for convenience) connects to the regulator 830 at the inlet 125. The outlet 250 connects to an inflatable boat 840 to receive the air for inflation.

The radial configuration, with the non-axisymmetric housing 410, considered utilized both the Coanda and Venturi effects, and was based on conventional aspirator nozzles commonly used for industrial cooling applications. The inline configuration, with the inline housing 110, was easier to produce than the radial version via additive manufacturing and relies solely on the Venturi effect. The inline configuration was eventually selected as the final design choice for boat inflation.

The radial configuration, shown in cross section in view 400, derives from conventional aspiration valves, with an angular nozzle directing air in from a single inlet through the bottom of the device. The compressed air is directed through the small opening of the ring nozzle 535 and adheres to the walls, through the Coanda effect. At this opening, the high velocity of the air creates an area of low pressure, which entrains ambient air through the inlet 170 and 470. This mixture of air from the tank 810 and ambient air from the atmosphere flows into the boat 840, and so less air is needed from the SCUBA tank 810 to achieve inflation.

The radial configuration has several advantages over the inline configuration. The axial air inlet enables a threaded check valve to be installed, easily facilitating the transition from inflation (from zero to maximum volume) to pressurization. This avoids wasting air through backpressure from the boat 840. However, a significant disadvantage exists in the manufacturability of this design. Removing the support material from the interior nozzle is impossible on most printers and extremely difficult in others. Splitting the housing 410 into two pieces was explored, but the eventually radial design was discarded in favor of the unibody inline assembly 190.

The inline layout, shown in cross section in view 200, was a novel design developed for manufacture on any three-dimensional (3D) printer, regardless of support material type. Due to the air proceeding straight from the tank inlet to the boat output, the Coanda effect is not involved, and amplification relies solely on the Venturi effect. Compressed air flows through the central channel and exits as a developed stream adjacent to the ambient air inlets. The Venturi effect creates an area of low pressure around the stream, entraining ambient air to supplement the compressed air on its way to the boat 840.

While the boat 840 is inflating from a completely deflated state to its maximum volume, amplification is efficiently achieved. However, once inflation begins, backpressure from the boat 840 causes air to escape from the air inlets 170 and 470, expelling compressed air flow 270 into the outside environment. Check valves were designed, printed via additive manufacturing, and fit into the air inlets 170 and 470. These check valves, while functional, introduced too much resistance to air flow, and greatly reduced the effectiveness of the amplifier 830. Instead, a turnable cinch ring 180 was designed, which functions as a manual check valve. Once the boat 840 reaches full volume and begins to pressurize, the operator closes the valve by screwing the cinch ring 180 forward and pressurizes the boat 840 without losing any air.

Empirical tests were conducted, each beginning with a completely deflated boat 840. An amplifier (radial or inline) 830 was connected between the boat 840 and the pressure regulator 820, which was connected to the SCUBA tank 810. Air at ~120 psi flowed from the regulator 820 through the amplifier 830, and finally, into the boat 840, which was permitted to inflate until backpressure within caused air to flow out from the ambient air inlets 170 on the amplifier 830. This tested the volume-increasing portion of inflation, without pressurization. FIG. 9 shows tabular views 900 of the data collected. Table 1 illustrates initial field test results 910 with final pressure in the boat 840 limited to 0.21 psig. Table 2 illustrates comparison results 920. Table 3 illustrates full-inflation test results 930 with pressurization reaching 3.5 psi.

The inline amplifier 190 required less air from the tank 810 to fully inflate the boat 840 and used comparatively more atmospheric air than the radial amplifier 410. This is due to the internal nozzle in the conduit 220 restricting the amount of air flow from the tank 810 while maintaining a high velocity to develop low pressure as provided in Table 1. The time required to inflate the boat 840 was significantly longer than the corresponding time required by the radial amplifier 410, which nonetheless garnered an impressive amplification factor, but more impressive was the latter's drastically lower amplification time.

Another iteration of the inline amplifier was subsequently tested with alteration of the internal geometry (with a wider conduit 220 for greater airflow but less amplification, as provided in Table 2. Unfortunately, pressure regulators were unavailable, and so shop air was used instead of high-pressure tanks, leading to inability to measure air flow. Nonetheless, this permitted time to inflation to compare a control test without the amplifier, and an evaluation test with the exemplary inline amplifier. Both inflations were stopped once the pressure within the boat began increasing above atmospheric pressure.

A dual-amplification test enabled evaluation of inflation time to maximum volume of the boat 840. The test also continued into pressurization with closed inlets, providing an amplification factor for the entire inflation process. Table 3 provides the results for the test. Comparing the full volume inflation time to previous tests indicated that the dual amplifier system inflated considerably faster than a single amplifier. This test confirmed that the system could achieve an amplification factor similar to the original inline amplifier. Incorporation of two amplifiers did not require use of two compressed air tanks.

Additive manufacturing enabled the prototyping and testing of intermediate designs between field tests. These tests were conducted with a small air compressor and an air mattress. The pressure gauge on the air compressor, combined with the known volume on the air mattress, gave enough information to calculate the amplification factor. The amplifier has achieved a technical readiness level (TRL) of seven: system prototype demonstration in an operational environment.

Several obstacles remain before reaching a TRL of eight (actual system completed and qualified through test and demonstration). These include:

(1) The presence of a check valve between the boat 840 and the amplifier 830 will be required to prevent air loss when the amplifier 830 is removed.

(2) The design may be able to be changed to be compatible with traditional manufacturing methods such as injection molding for high-volume production, when needed.

The proposed valve in (1) was not present during testing, due to introduction of excessive resistance to airflow at the tested pressure. Solutions may include a new check valve on the boat 840, which would operate mechanically, not relying on air pressure for opening. This would reduce the resistance to airflow during operation. Additionally, building the amplifier 830 may possibly be manufactured directly into the boat 840, eliminating the need for a check valve. Through the many iterations of the amplifier 830, the concept has been demonstrated to function, and subsequently, the design was optimized to reduce the inflation time by 50 percent.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An augmentation amplifier, connected at an inlet to pressurized gas, source end at an outlet to a gas receiver, for aspirating gas flow from a surrounding medium, said aspirator comprising:

a Venturi conduit including a throat for receiving and flowing pressurized gas from the inlet to said throat;

an external cavity for receiving ambient gas from the medium; and a diffusion chamber for expanding and accelerating said pressurized gas from said throat into an accelerated gas to entrain said ambient gas for combining into an exhaust gas to the outlet, wherein said chamber enables backflow from the outlet by venting through said cavity upon overpressure of the receiver.

2. The amplifier according to claim 1, further including an obstruction to said cavity for isolating said chamber from the medium.

3. The amplifier according to claim 1, further including a housing that integrates said conduit, said cavity and said chamber.

4. The amplifier according to claim 3, wherein said housing is substantially axisymmetric, such that the inlet and the outlet connect in line with said housing.

5. The amplifier according to claim 1, wherein the inlet laterally ports to said housing, said conduit and said throat are annular, and said cavity is in line with the outlet.

6. The amplifier according to claim 3, wherein said conduit and said throat are axisymmetric, and said cavity is annular.

7. The amplifier according to claim 1, wherein the medium is atmospheric air and the source is a compressed gas bottle.

8. The amplifier according to claim 2, wherein said obstruction to said cavity is adjustable for connecting the medium to said chamber.

9. The amplifier according to claim 2, wherein said conduit and said throat are axisymmetric, said cavity, is annular and coaxial to said throat, and said obstruction forms a ring to translate coaxially over said cavity.

* * * * *